US006142184A

United States Patent [19]

Yen

[11] Patent Number: 6,142,184

[45] Date of Patent: Nov. 7, 2000

[54] SPOUT ASSEMBLY ADAPTED TO BE IN FLUID COMMUNICATION WITH A FAUCET

[75] Inventor: David Yen, Taichung, Taiwan

[73] Assignee: Globe Union Industrial Corporation, Taiwan

[21] Appl. No.: 09/401,282

[22] Filed: Sep. 23, 1999

[51] Int. Cl.[7] ..... E03C 1/02

[52] U.S. Cl. ..... 137/801; 4/678; 239/587.1

[58] Field of Search ..... 4/678; 137/801; 239/587.1; 285/302

[56] References Cited

U.S. PATENT DOCUMENTS

| | | | |
|---|---|---|---|
| 1,758,115 | 5/1930 | Kelly | 239/587.1 X |
| 2,100,186 | 11/1937 | Hogopian | 239/587.1 X |
| 2,776,168 | 1/1957 | Schweda | 239/587.1 X |

*Primary Examiner*—Gerald A. Michalsky
*Attorney, Agent, or Firm*—Foley & Lardner

[57] ABSTRACT

A spout assembly includes an inner tube adapted to be in fluid communication and in watertight connection with a faucet body, and an outer tube telescopically fitted on the inner tube. The outer tube includes a proximate tubular end slidably fitted on an outer circumferential wall of the inner tube, a distal tubular end extending beyond the inner tube, and an inner peripheral wall facing the outer circumferential wall. A lock member includes a latch portion disposed in the inner peripheral wall, and a stem portion extending from the latch portion and radially and outwardly of the outer tube so as to permit an external operation of the stem portion. Thus, the latch portion is radially movable between an arrested position, where the latch portion is registered with and extends into one of the retaining recesses of the outer circumferential wall so as to arrest the inner peripheral wall from moving relative to the outer circumferential wall, and a retracted position, where the latch portion is radially moved to be relieved from the retaining recess and to permit sliding movement of the inner peripheral wall relative to the outer circumferential wall. A biasing member is disposed to bias the latch portion to extend into one of the retaining recesses in the arrested position.

8 Claims, 5 Drawing Sheets

SPOUT ASSEMBLY ADAPTED TO BE IN FLUID COMMUNICATION WITH A FAUCET

BACKGROUND OF THE INVENTION

1. Field of the Invention

This invention relates to a spout assembly adapted to be in fluid communication with a faucet, more particularly to a spout assembly with telescopic inner and outer tubes and a lock member to retain the outer tube relative to the inner tube.

2. Description of the Related Art

Referring to FIG. 1, a conventional faucet is shown to be mounted on a kitchen sink 4 and includes a faucet body 1, a valve 2 to control the flow of water stream into the faucet body 1, and a spout 3 mounted on and movable relative to the faucet body 1 toward dish accommodating spaces 4*a*,4*b*. Since the length of the spout 3 is fixed, it is difficult for the flow of water stream from the spout 3 to reach the surrounding wall of the larger dish accommodating space 4*a*, thereby causing inconvenience to the user.

SUMMARY OF THE INVENTION

The object of the present invention is to provide a spout assembly which has telescopic outer and inner tubes adapted to be mounted on and in fluid communication with a faucet body and a lock member to retain the outer tube relative to the inner tube.

According to this invention, the spout assembly includes an inner tube and an outer tube telescopically fitted on the inner tube. The inner tube includes a first tubular end portion adapted to be in fluid communication and in watertight connection with a faucet body, a second tubular end portion opposite to the first tubular end portion in an axial direction, and an intermediate tubular portion interposed therebetween. The outer tube includes a proximate tubular end which is slidably fitted on an outer circumferential wall of the intermediate tubular portion and proximate to the first tubular end portion, a distal tubular end opposite to the proximate tubular end and extending beyond the second tubular end portion, and a middle tubular portion interposed between the proximate and distal tubular ends. The middle tubular portion has an inner peripheral wall facing the outer circumferential wall and including first and second segments respectively proximate and distal to the proximate tubular end. The outer circumferential wall of the intermediate tubular portion has a plurality of retaining recesses spaced apart from and aligned with one another in the axial direction. A lock member includes a latch portion disposed in the inner peripheral wall, and a stem portion extending from the latch portion and radially and outwardly of the middle tubular portion so as to permit an external operation of the stem portion. The latch portion is radially movable between an arrested position, where the latch portion is registered with and extends into one of the retaining recesses so as to arrest the inner peripheral wall from moving relative to the outer circumferential wall, and a retracted position, where the latch portion is radially moved to be relieved from the retaining recess and to permit sliding movement of the inner peripheral wall relative to the outer circumferential wall. A biasing member is disposed to bias the latch portion to extend into the retaining recess in the arrested position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
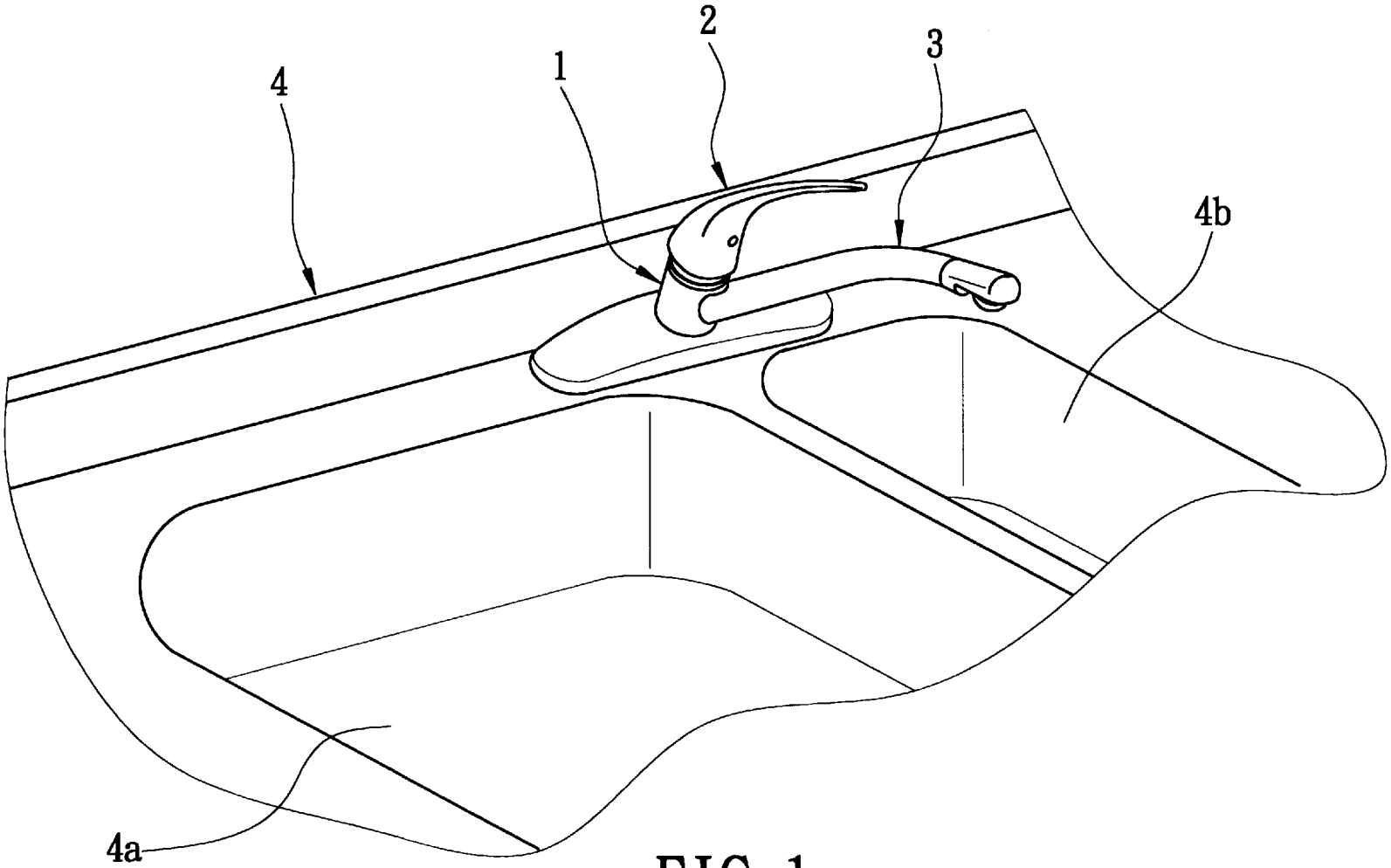
FIG. 1 PRIOR ART
FIG. 1 is a schematic perspective view of a conventional faucet on a kitchen sink.
Figure 2:
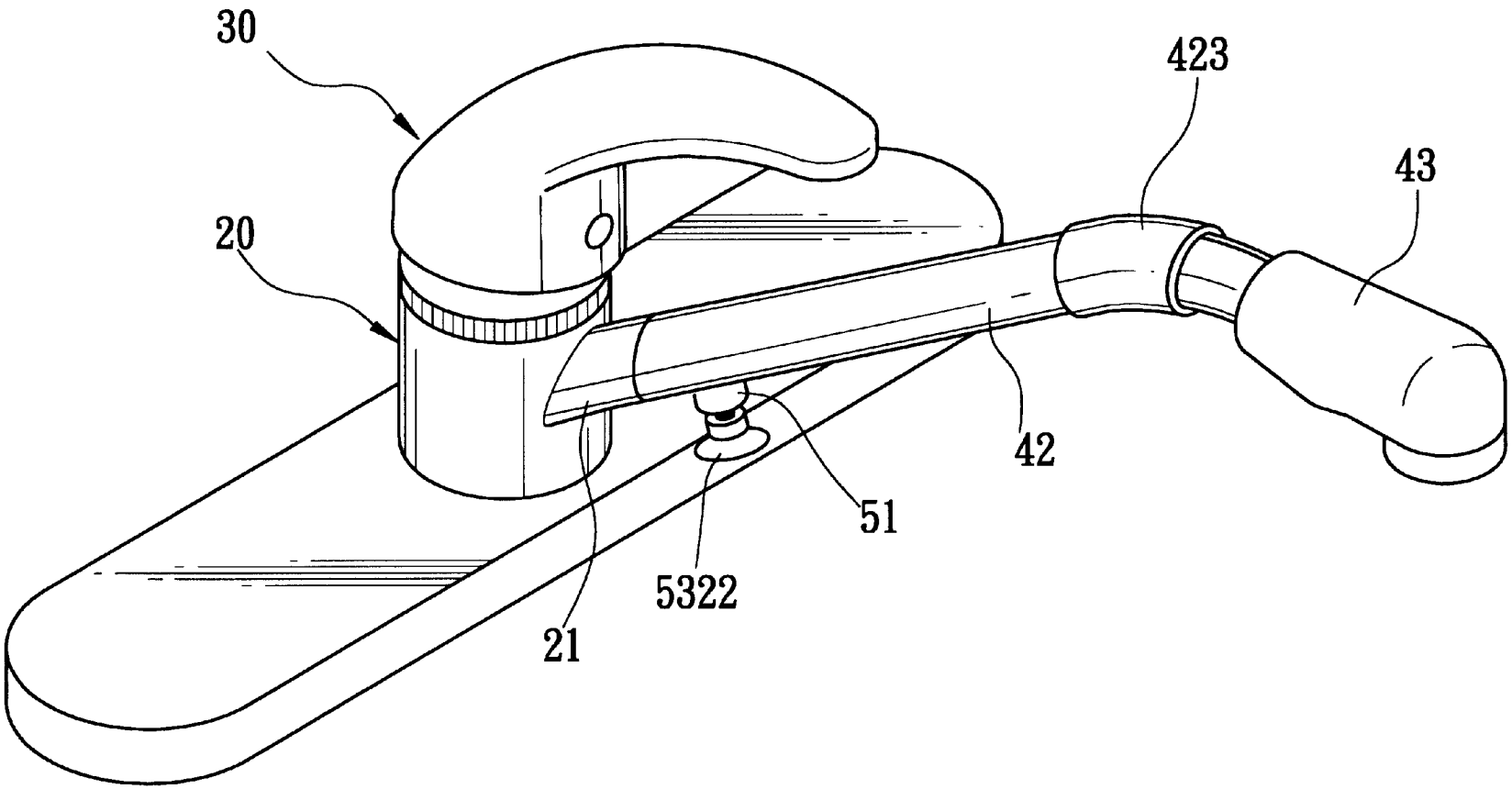
FIG. 2 is a perspective view of a preferred embodiment of a spout assembly according to this invention when mounted on a faucet body.
Figure 3:
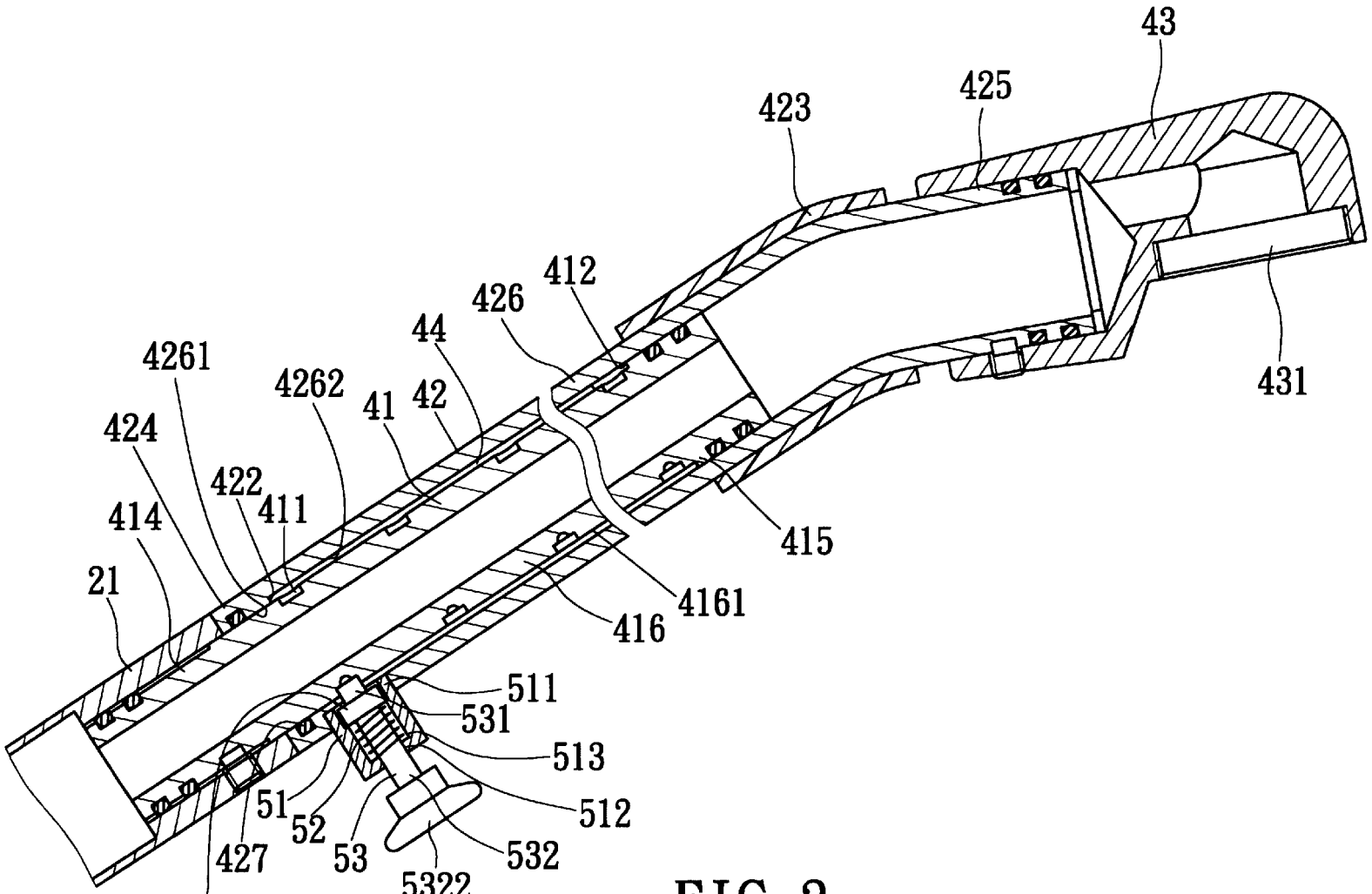
FIG. 3 is a sectional view of the preferred embodiment.

Referring to FIG. 2, the preferred embodiment of the spout assembly according to the present invention is shown to be mounted on and in fluid communication with a faucet body 20 of a faucet. The faucet has a valve 30 to control the flow of water stream into the faucet body 20. With reference to FIG. 3, the spout assembly includes an inner tube 41 and an outer tube 42 which is telescopically fitted on the inner tube 41.

The inner tube 41 includes a first tubular end portion 414 which is adapted to be in fluid communication and in water tight connection with an outlet tube 21 of the faucet body 20, a second tubular end portion 415 opposite to the first tubular end portion 414 in a first axial direction, and an intermediate tubular portion 416 which is interposed between the first and second tubular end portions 414,415, and which has an outer circumferential wall 4161. The outer circumferential wall 4161 has a plurality of annular retaining recesses 411 which are disposed therein, and which are spaced apart from and aligned with one another in the first axial direction.

The outer tube 42 includes a proximate tubular end 424 which is slidably fitted on the outer circumferential wall 4161 and proximate to the first tubular end portion 414, a distal tubular end 425 which is disposed opposite to the proximate tubular end 424 and which extends beyond the second tubular end portion 415, and a middle tubular portion 426 which is interposed between the proximate and distal tubular ends 424,425. The middle tubular portion 426 has an inner peripheral wall which faces the outer circumferential wall 4161 and which includes first and second segments 4261,4262 respectively proximate and distal to the proximate tubular end 424. The second segment 4262 is radially spaced from the outer circumferential wall 4161. In particular, the middle tubular portion 426 has an annular abutment shoulder 422 which is disposed radially at a juncture of the first and second segments 4261,4262. The outer circumferential wall 4161 has an annular barrier portion 412 which is disposed proximate to the second tubular end portion 415 so as to cooperate with the abutment shoulder 422 to confine an annular accommodating area 44 between the second segment 4262 and the outer circumferential wall 4161. Thus, the abutment shoulder 422 will be blocked by the barrier portion 412 from further movement during the sliding movement of the first segment 4261 relative to the outer circumferential wall 4161 so as to prevent the first segment 4261 from slipping over and falling out of the second tubular end portion 415.

An annular friction member 427 is disposed in the first segment 4261 and is in slidable contact with the outer circumferential wall 4161 so as to retard the sliding movement of the first segment 4261 relative to the outer circumferential wall 4161.

A housing 51 is mounted in and extends radially and outwardly of the middle tubular portion 426 adjacent to the proximate tubular end 424. The housing 51 has an open end wall 511 to communicate with the second segment 4262, and an abutment wall 512 which is spaced apart from the open end wall 511 in a second axial direction that is radial to the first axial direction, so as to define an accommodating chamber 513. A lock member 53 includes a latch portion 531 which is disposed in the second segment 4262, and a stem portion 532 which extends from the latch portion 531. The stem portion 532 passes through the open end wall 511 as well as the accommodating chamber 513 to extend outwardly of the abutment wall 512 in the second axial direction so as to permit external operation of the stem portion 532. An enlarged abutment portion 5321 and an enlarged operating portion 5322 are disposed on two ends of the stem portion 532. A biasing member 52, such as a compression spring, is received in the accommodating chamber 513 and is sleeved around the stem portion 532. The biasing member 52 has first and second ends engaging the enlarged abutment portion 5321 and the abutment wall 512, respectively.

A spout head 43 is mounted on the distal tubular end 425 of the outer tube 42, and has an outlet 431 for changing directions of the water stream.

In addition, a scald-preventing member 423 can be disposed to wrap around the middle tubular portion 426 proximate to the distal tubular end 425 to serve as a handgrip.

Figure 4:
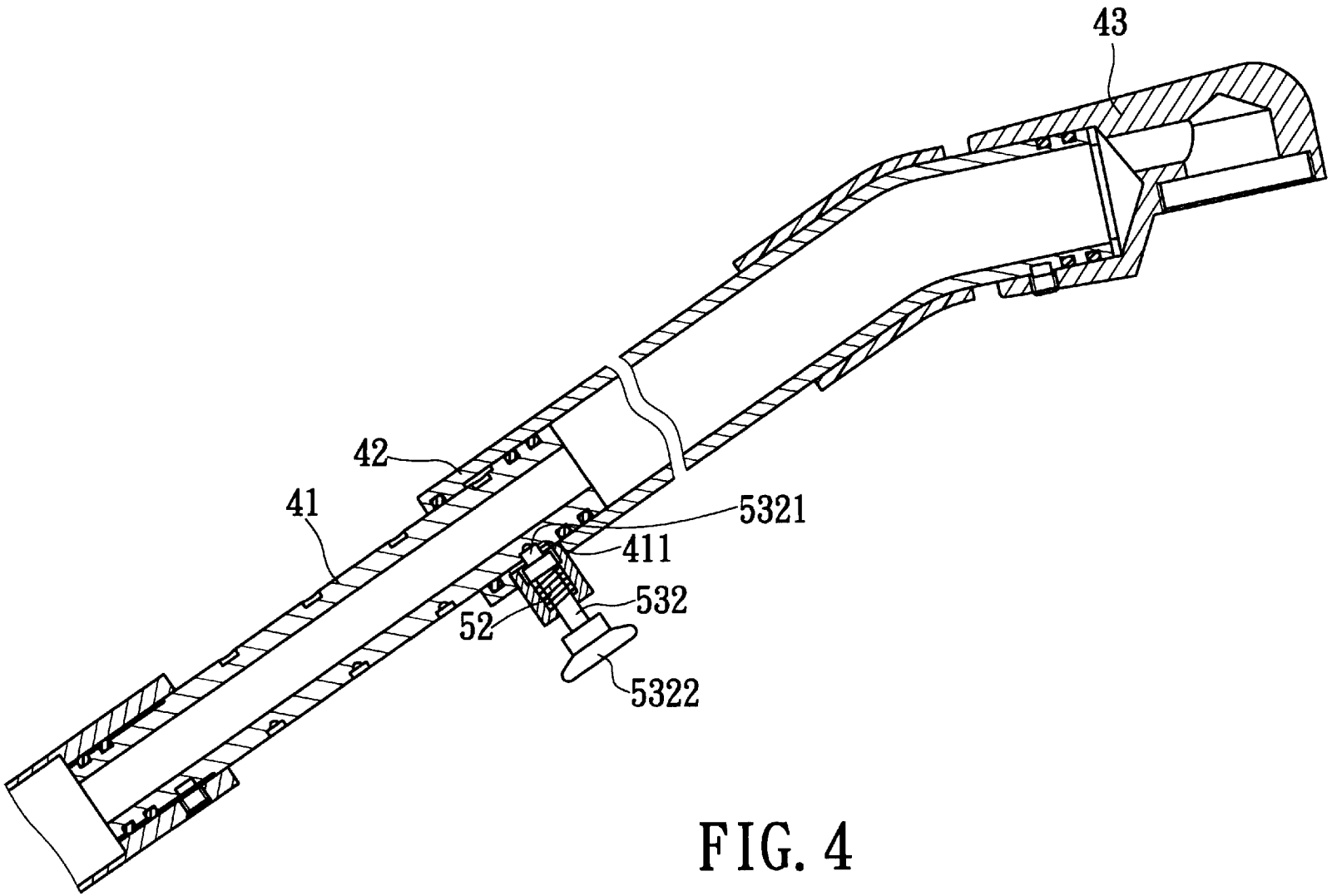
FIG. 4 is a sectional view of the preferred embodiment in an extended state.
Figure 5:
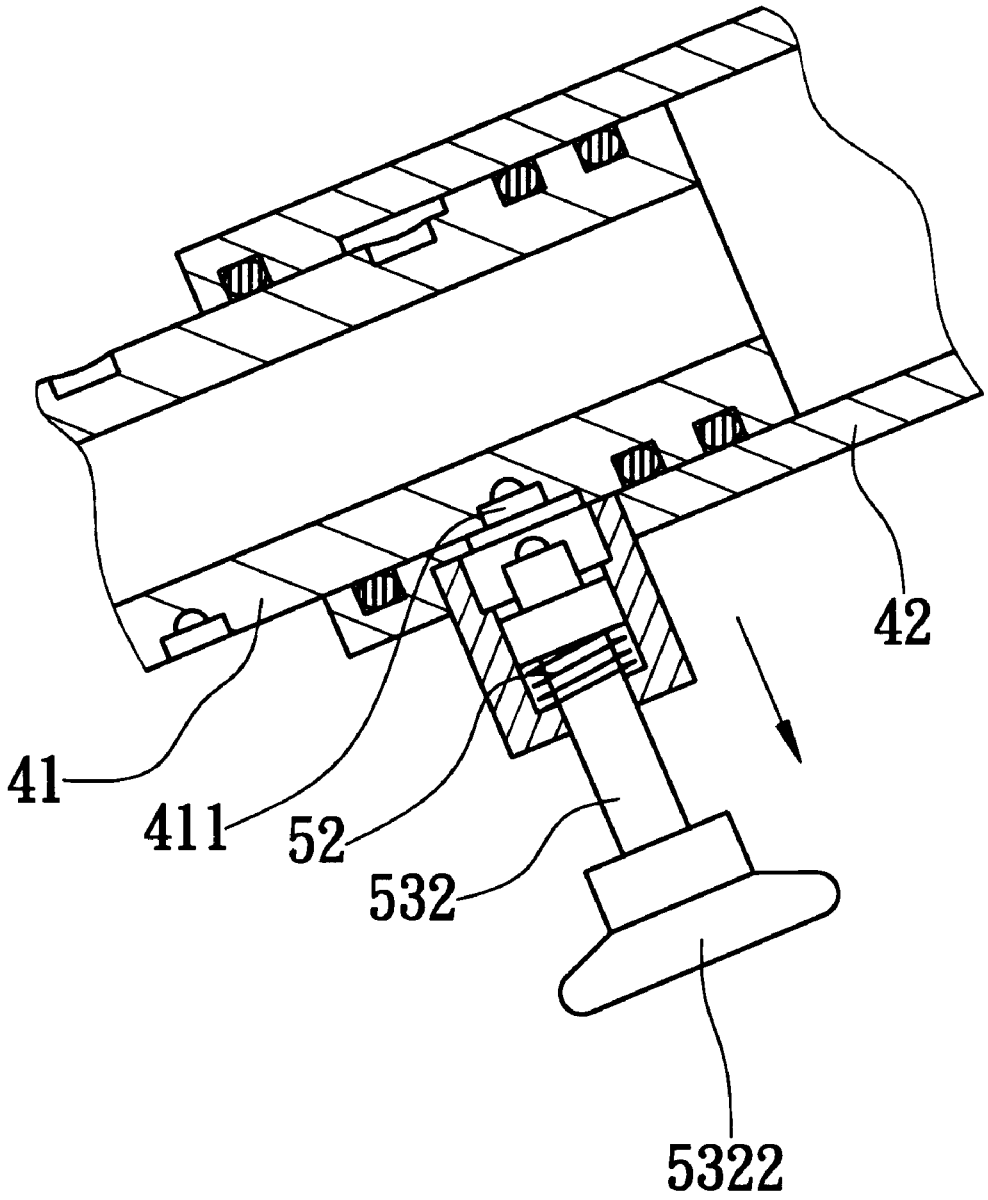
FIG. 5 is a fragmentary sectional view showing a lock member of the preferred embodiment in a retracted position.

As illustrated, the latch portion 532 is movable in the second axial direction between an arrested position, as shown in FIG. 3, where the latch portion 532 is registered with and extends into one of the retaining recesses 411 and is retained within the retaining recess 411 so as to arrest the inner peripheral wall of the outer tube 42 from moving relative to the outer circumferential wall 4161 of the inner tube 41, and a retracted position, as shown in FIG. 5, where, by pulling the enlarged operating portion 5322 outwardly against the biasing force of the biasing member 52, the latch portion 532 is moved to be relieved from the retaining recess 411 so as to permit sliding movement of the inner peripheral wall of the outer tube 42 relative to the outer circumferential wall 4161 of the inner tube 41 and increase the distance between the spout head 43 and the outlet tube 21, as shown in FIG. 4.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A spout assembly adapted to be in fluid communication with a faucet body of a faucet which includes a valve to control the flow of water stream into the faucet body, said spout assembly comprising:

an inner tube including a first tubular end portion adapted to be in fluid communication and in watertight connection with the faucet body, a second tubular end portion opposite to said first tubular end portion in a first axial direction, and an intermediate tubular portion interposed between said first and second tubular end portions, and having an outer circumferential wall, wherein said outer circumferential wall has a plurality of retaining recesses disposed therein, and spaced apart from and aligned with one another in the first axial direction;

an outer tube telescopically fitted on said inner tube, and including a proximate tubular end slidably fitted on said outer circumferential wall and proximate to said first tubular end portion, a distal tubular end opposite to said proximate tubular end and extending beyond said second tubular end portion, and a middle tubular portion interposed between said proximate and distal tubular ends, and having an inner peripheral wall that faces said outer circumferential wall and that includes first and second segments respectively proximate and distal to said proximate tubular end;

a lock member including a latch portion disposed in said inner peripheral wall and a stem portion extending from said latch portion and radially and outwardly of said middle tubular portion so as to permit an external operation of said stem portion, said latch portion being radially movable between an arrested position, where said latch portion is registered with and extends into one of said retaining recesses and is retained within said one of said retaining recesses so as to arrest said inner peripheral wall from moving relative to said outer circumferential wall, and a retracted position, where said latch portion is radially moved to be relieved from said one of said retaining recesses and to permit sliding movement of said first segment relative to said outer circumferential wall; and a biasing member disposed to bias said latch portion to extend into said one of said retaining recesses in the arrested position.

2. The spout assembly as claimed in claim 1, further comprising a friction member disposed in said first segment and in slidable contact with said outer circumferential wall so as to retard the sliding movement of said first segment relative to said outer circumferential wall.

3. The spout assembly as claimed in claim 1, wherein said second segment of said middle tubular portion is radially spaced from said outer circumferential wall to define an annular accommodating area therebetween.

4. The spout assembly as claimed in claim 3, wherein said middle tubular portion has an annular abutment shoulder disposed radially at a juncture of said first and second segments, said outer circumferential wall having an annular barrier portion disposed proximate to said second tubular end portion and cooperating with said abutment shoulder to confine said annular accommodating area in the first axial direction such that said abutment shoulder will be blocked by said barrier portion from further movement during the sliding movement of said first segment relative to said outer circumferential wall so as to prevent said first segment from slipping over and falling out of said second tubular end portion.

5. The spout assembly as claimed in claim 1, further comprising a housing mounted in and extending radially and outwardly of said middle tubular portion, and having an open end wall to communicate with said inner peripheral wall and an abutment wall spaced apart from said open end wall in a second axial direction that is radial to the first axial direction, so as to define an accommodating chamber to receive said biasing member, wherein said stem portion is brought to pass through said open end wall as well as said accommodating chamber and extend outwardly of said abutment wall in the second axial direction so as to permit the external operation of said stem portion.

6. The spout assembly as claimed in claim 5, wherein said biasing member is a compression spring having a first end engaging said stem portion adjacent to said latch portion and a second end engaging said abutment wall.

7. The spout assembly as claimed in claim 1, further comprising a spout head mounted on said distal tubular end for changing directions of the water stream.

8. The spout assembly as claimed in claim 1, further comprising a scald-preventing member disposed to wrap around said middle tubular portion.

* * * * *